United States Patent [19]

Liknes et al.

[11] 3,932,111

[45] Jan. 13, 1976

[54] APPARATUS FOR INCINERATING COMBUSTIBLE WASTES

[75] Inventors: Alvin C. Liknes; Lyle C. Knight, both of Edmonton, Canada

[73] Assignee: Black, Sivalls & Bryson, Inc., Houston, Tex.

[22] Filed: Oct. 29, 1974

[21] Appl. No.: 518,280

[52] U.S. Cl. ..... 431/202; 23/277 C

[51] Int. Cl.[2] ..... F23D 13/20

[58] Field of Search ..... 431/202, 278, 285; 23/277 C

[56] References Cited

UNITED STATES PATENTS

| | | | |
|---|---|---|---|
| 3,247,885 | 4/1966 | Reed | 431/202 |
| 3,554,681 | 1/1971 | Proctor | 431/202 |
| 3,833,336 | 9/1974 | Ray | 431/202 |

*Primary Examiner*—Edward G. Favors
*Attorney, Agent, or Firm*—C. Clark Dougherty, Jr.

[57] ABSTRACT

The present invention relates to apparatus for incinerating combustible wastes wherein a pilot light for igniting the wastes is provided at a location remote from a source of fuel for said pilot light. By the present invention, a pilot light burner is provided at the remote location and a fuel jet-ejector for producing a combustible mixture of fuel and air is provided at the location of the source of fuel. A first conduit connects the fuel-air mixture discharge connection of the jet-ejector to the pilot light burner and a second conduit connects the source of fuel to the fuel inlet connection of the jet-ejector. A third conduit is provided connected to the second conduit and to the pilot light burner for conducting fuel directly to the burner separately from the fuel-air mixture conducted thereto by way of the first conduit.

12 Claims, 2 Drawing Figures

APPARATUS FOR INCINERATING COMBUSTIBLE WASTES

BACKGROUND OF THE INVENTION

1. Field of the Invention

The present invention relates generally to apparatus for incinerating combustible wastes, and more particularly, but not by way of limitation, to flare type incinerators wherein a pilot light is provided for igniting the combustible wastes being incinerated.

2. Description of the Prior Art

Many various arrangements of apparatus and techniques have been utilized for incinerating or flaring combustible wastes. For example, oil refineries and gasoline plants commonly utilize flare stacks for incinerating combustible wastes in both the liquid and vapor state. These combustible wastes are generally hydrocarbons which must be incinerated because of equipment failures. While the duration of such waste incineration is generally short, in order to insure the safety of personnel and the surrounding environment as well as to prevent pollution of the atmosphere, the incineration is often required to take place at a distance above ground level so that the heat and combustion products generated are effectively dispersed into the atmosphere.

In operation of flare stacks and similar apparatus for incinerating wastes, a pilot light or flame is continuously provided at the point where the waste is discharged into the atmosphere so that ignition thereof automatically occurs. Numerous problems have been experienced in continuously maintaining such pilot flames due to wind gusts and the necessity of locating the pilot burner at inaccessible remote locations above ground level. Often monitoring of the pilot flame is carried out manually, and consequently, is unreliable. On the other hand, automatic pilot light apparatus have been expensive and have included elaborate provisions for automatically igniting and reigniting the pilot flames remotely.

By the present invention an improved apparatus for incinerating combustible wastes is provided which obviates the above-mentioned problems.

SUMMARY OF THE INVENTION

The present invention relates to apparatus for incinerating combustible wastes comprising a flare stack connected to the source of the combustible wastes and a pilot light burner attached to the flare stack and positioned with respect thereto so that combustible wastes discharged from the flare stack are ignited by the pilot light. A first conduit is provided attached to the pilot light burner for conducting fuel and air to the burner, and a fuel jet-ejector for producing a combustible mixture of fuel and air is provided having a fuel inlet connection, an air inlet connection and a fuel-air mixture discharge connection. The fuel-air mixture discharge connection of the jet-ejector is connected to the first conduit, and a second conduit is provided connecting the fuel inlet connection of the jet-ejector to a source of fuel. A third conduit is provided connected to the second conduit and to the pilot light burner for conducting fuel directly to the burner separately from the fuel-air mixture conducted thereto by the first conduit.

It is, therefore, an object of the present invention to provide an improved apparatus for incinerating combustible wastes which is relatively inexpensive to install and operate.

A further object of the present invention is the provision of an improved apparatus for incinerating combustible wastes whereby a continuous stable pilot light is provided for igniting the wastes.

Another object of the present invention is the provision of apparatus for providing a stable pilot light at a remote and inaccessible location which can be simply and easily serviced, ignited and reignited and the intensity thereof adjusted.

Yet a further object of the present invention is the provision of improved apparatus for incinerating combustible wastes wherein a continuous pilot flame is provided which can be readily ignited and adjusted remotely without the need for expensive and elaborate equipment.

Still another object of the present invention is the provision of an improved apparatus for incinerating combustible wastes which achieves reliable monitoring of the pilot flame whereby a flame failure condition is immediately detected.

Other objects, features and advantages of the invention will be readily apparent to those skilled in the art upon a reading of the description of preferred embodiments of the invention which follows taken in conjunction with the accompanying drawings.

DESCRIPTION OF THE PREFERRED EMBODIMENTS

Figure 1:
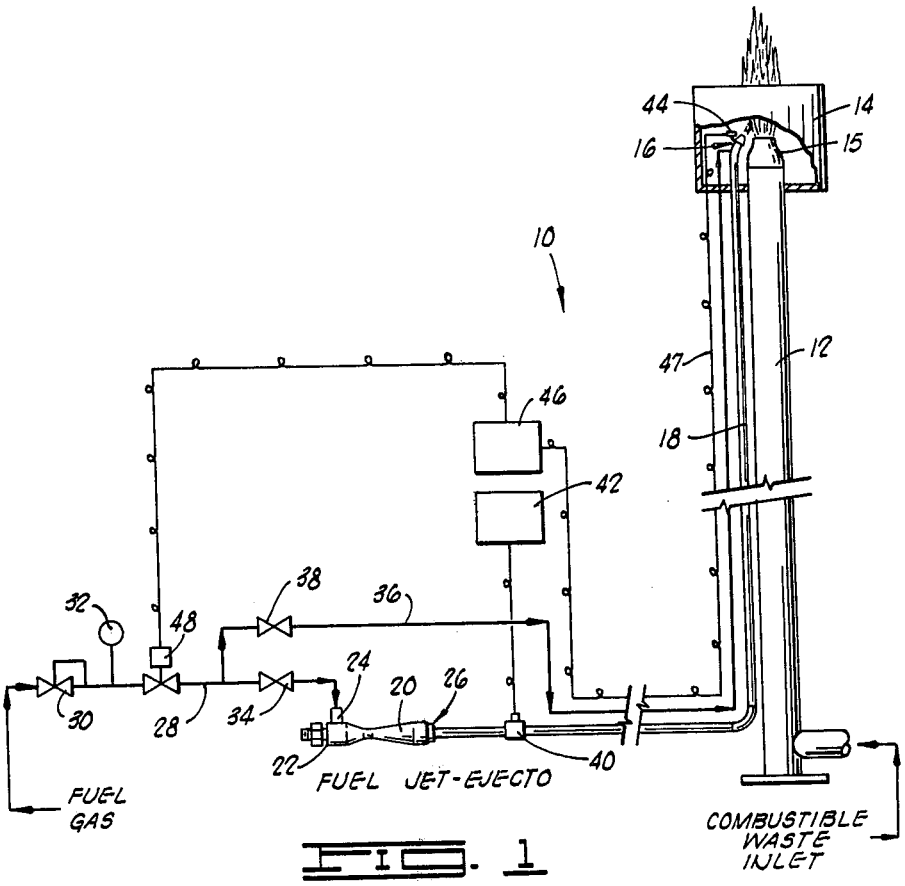
FIG. 1 is a diagrammatic view of the apparatus of the present invention.

Referring now to the drawings, and particularly to FIG. 1, the apparatus of the present invention is illustrated and generally designated by the numeral 10. The apparatus 10 includes a flare stack 12 which is connected to a source of combustible wastes to be incinerated. The flare stack 12 may take a variety of forms, but generally is comprised of a relatively high vertical conduit or stack so that incineration of the combustible wastes takes place at a location above ground level. However, as is well understood by those skilled in the art, the flare 12 can be positioned horizontally or otherwise and the incineration can take place at or below ground level, such as in a waste material pit.

The upper open end 15 of the flare stack 12 includes a conventional shroud 14 attached thereto for deflecting wind gusts and facilitating stable flame patterns.

A pilot light burner generally designated by the numeral 16 is provided attached to the flare stack 12 for igniting combustible wastes discharged therefrom. A first conduit 18 is connected to the pilot light burner 16 which extends to a location remote from the end 15 of the flare stack 12. Generally, the conduit 18 extends to a location at ground level a desired distance from the flare stack 12, at which location there is a source of fuel gas and from where it is desirable to remotely operate the pilot light burner.

A conventional fuel jet-ejector 20 is provided at the operating location remote from the flare stack 12 having an adjustable air inlet 22, a fuel inlet connection 24 and a fuel-air mixture discharge connection 26. The fuel-air mixture discharge connection 26 of the ejector 20 is connected to the conduit 18. A second conduit 28 is provided connected to the fuel inlet connection of the jet-ejector 20 and to a source of fuel gas.

A conventional downstream fuel gas pressure regulator 30 is provided disposed in the conduit 28 and a conventional pressure indicator or gauge 32 is provided downstream of the regulator 30. A shut-off valve 34 is also disposed in the conduit 28, and a third conduit 36 is connected to the conduit 28 between the pressure gauge 32 and the shut-off valve 34. The third conduit 36 includes a conventional shut-off valve 38 disposed therein and is connected to the pilot light burner 16 at its location remote from the fuel jet-ejector 20, the conduit 28 and other equipment associated therewith.

A conventional electric ignitor 40 is disposed within the first conduit 18 just downstream of the jet-ejector 20, and a conventional high voltage electric power source 42 is operably connected to the ignitor 40.

A fuel combustion detection device 44 is provided attached to the burner 16. The device 44 is operably connected to a conventional combustion detector control panel 46 and a safety shut-down valve 48 is provided disposed in the conduit 28 operably connected to the combustion detection control panel 46.

Figure 2:
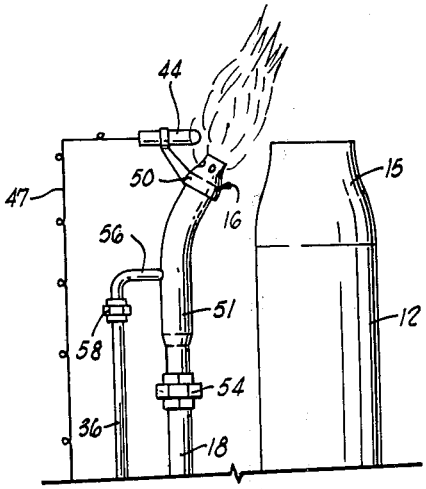
FIG. 2 is an enlarged view of a portion of the apparatus illustrated in FIG. 1.

Referring now to FIG. 2, an enlarged view of the upper portion of the flare stack 12, the burner 16 and the combustion detection device 44 are shown. As illustrated, the burner 16 is positioned with respect to the upper open end 15 of the flare stack 12 so that the pilot flame produced extends over and above the end 15 whereby combustible wastes discharged therefrom are readily and automatically ignited.

The burner 16 is comprised of a nozzle 50 connected to a mixing tube 51. The mixing tube 51 is connected to the first conduit 18 by a conventional union or other connector 54. The third conduit 36 is connected to an inlet conduit 56 attached to the mixing tube 51 by means of a conventional union or other connector 58.

The combustion detection device 44 is attached to the burner nozzle 50 in a manner such that it extends into the pilot flame produced by the burner. As will be understood, a variety of combustion detection devices are commercially available and can be used in accordance with the present invention. However, a conventional thermocouple is suitable for use with the apparatus 10 connected to a conventional combustion detection control panel 46 by a lead wire 47.

OPERATION OF THE SYSTEM 10

In operation of the system 10, a stream of fuel gas is caused to flow through the pressure regulator 30 wherein the pressure level thereof is reduced to a desired level, through the conduit 28 and the valve 34 and into the fuel inlet connection 24 of the jet-ejector 20. As the stream of fuel gas passes through the jet-ejector 20, air is inspirated into the jet-ejector 20 by way of the adjustable air inlet 22 and mixes with the fuel. As will be understood, the ratio of air to fuel produced by the jet-ejector 20 is adjusted by opening or closing the adjustable inlet connection 22 on the jet-ejector 20 and/or by increasing or decreasing the flow and/or pressure level of the fuel gas stream conducted to the jet-ejector 20.

The resulting combustible mixture of air and fuel flows through the discharge connection 26 of the ejector 20 and into the first conduit 18 connected to the burner 16.

The ignitor 40 is next provided with high voltage electric power from the source 42 so that the fuel-air mixture passing through the conduit 18 is ignited. Combustion or flame is propagated from the ignitor 40 within the conduit 18 to the burner 16 and through the burner nozzle 50 thereof so that a pilot flame is provided at the burner 16 for igniting combustible wastes discharged from the flare stack 12.

In order to provide stability to the pilot flame extending above the burner nozzle 50 of the burner 16, a separate stream of fuel is caused to flow through the third conduit 36 connected to the mixing tube 51 by opening the valve 38. This separate stream of fuel gas flows into the mixing tube 51 of the burner 16 wherein it mixes with the fuel-air mixture flowing through the mixing tube 52 from the first conduit 18. By providing this separate stream of fuel gas to the burner 16 by way of the third conduit 36 an extremely stable flame can be maintained at the burner 16, the characteristics of which can be readily adjusted remotely without risking total loss or outage of the pilot flame. This is, the rate of fuel provided by way of the third conduit 36 is adjusted to provide an air-fuel mixture of the desired fuel richness and a resulting pilot flame of the desired stability and characteristics. In addition, the fuel provided by way of the third conduit 36 insures that on start-up of the system 10, the flame front propagated from the ignitor 40 within the conduit 18 comes into contact with ignitable gas at the burner 16.

The combustion detection device 44 senses the presence of combustion at the burner 16 and provides an electric signal to the combustion detection controller 46. The controller 46 functions in a conventional manner to maintain the safety shut-down valve 48 in an open position so long as combustion is detected at the burner 16. When the pilot flame is extinguished and combustion is not detected, the controller 46 functions to close the valve 48 thereby shutting off the flow of fuel to the burner 16. Also, the controller 46 is generally operably connected to an alarm and/or other shut-down devices so that the outage of the pilot flame is brought to the attention of operating personnel and prevents the flow of uncombusted wastes into the atmosphere.

As will be understood, reignition of the pilot flame can be accomplished manually by closing the valves 34 and 38 in the conduits 28 and 36 respectively, opening the safety shut-down valve 48 and then repeating the ignition procedure described above. Alternatively, conventional instruments and controls for automatically relighting the pilot flame can be provided with the system 10.

While presently preferred embodiments of the invention have been described for purposes of this disclosure, numerous changes in the arrangement and construction of the various parts can be made which will readily suggest themselves to those skilled in the art and which are emcompassed within the spirit of this disclosure and the scope of the appended claims.

What is claimed is:

1. Apparatus for incinerating combustible wastes comprising:

a flare stack connected to the source of said combustible wastes;

a pilot flame burner attached to said flare stack and positioned with respect thereto so that combustible wastes discharged therefrom are ignited by said pilot flame;

a first conduit attached to said pilot flame burner for continuously conducting fuel and air to said burner;

a fuel jet-ejector for producing a continuous stream of a combustible mixture of fuel and air having a fuel inlet connection, an air inlet connection and a fuel-air mixture discharge connection, said discharge connection being connected to said first conduit;

a second conduit connecting the fuel inlet connection of said fuel jet-ejector to a source of fuel; and a third conduit connected to said second conduit and to said pilot flame burner for conducting a continuous stream of fuel to said burner separately from the fuel-air mixture conducted thereto by said first conduit.

2. The apparatus of claim 1 which is further characterized to include valve means disposed in the third conduit for controlling the rate of fuel flowing therethrough to said pilot flame burner.

3. The apparatus of claim 2 which is further characterized to include valve means disposed in said second conduit for controlling the rate of fuel flowing therethrough to the fuel inlet connection of said fuel jet-ejector.

4. The apparatus of claim 3 which is further characterized to include ignition means disposed in said first conduit for igniting the fuel-air mixture flowing therethrough to said pilot flame burner.

5. The apparatus of claim 4 which is further characterized to include means attached to said pilot flame burner for detecting the presence of fuel combustion at said burner.

6. The apparatus of claim 5 which is further characterized to include valve means disposed in said second conduit operably connected to said means for detecting the presence of fuel combustion at said pilot flame burner so that the flow of fuel to said jet-ejector and to said third conduit is shut off when combustion at said pilot light burner is not detected by said detection means.

7. Apparatus for providing a pilot light at a location remote from a source of fuel which comprises:

a pilot light burner positioned at said remote location;

a fuel jet-ejector for producing a continuous stream of a combustible mixture of fuel and air positioned at the location of said source of fuel, said jet-ejector having a fuel inlet connection, an air inlet connection and a fuel-air mixture discharge connection;

a first conduit connecting the fuel-air mixture discharge connection of said jet-ejector to said pilot light burner;

a second conduit connecting said source of fuel to the fuel inlet connection of said jet-ejector; and a third conduit connected to said second conduit and to said pilot light burner for conducting a continuous stream of fuel to said burner separately from the fuel-air mixture conducted thereto by said first conduit.

8. The apparatus of claim 7 which is further characterized to include valve means disposed in the third conduit for controlling the rate of fuel flowing therethrough to said pilot light burner.

9. The apparatus of claim 8 which is further characterized to include valve means disposed in said second conduit for controlling the rate of fuel flowing therethrough to the fuel inlet connection of said fuel jet-ejector.

10. The apparatus of claim 9 which is further characterized to include ignition means disposed in said first conduit for igniting the fuel-air mixture flowing therethrough to said pilot light burner.

11. The apparatus of claim 10 which is further characterized to include means attached to said pilot light burner for detecting the presence of fuel combustion at said burner.

12. The apparatus of claim 11 which is further characterized to include valve means disposed in said second conduit and operably connected to said means for detecting the presence of fuel combustion at said pilot light burner so that the flow of fuel to said jet-ejector and to said third conduit is shut off when combustion at said pilot light burner is not detected by said detecting means.

* * * * *